US008085237B2

(12) United States Patent
Hong

(10) Patent No.: US 8,085,237 B2
(45) Date of Patent: Dec. 27, 2011

(54) METHOD FOR CONTROLLING LUMINANCE OF BACKLIGHT UNIT

(75) Inventor: Hee Jung Hong, Seoul (KR)

(73) Assignee: LG Display Co., Ltd., Seoul (KR)

( * ) Notice: Subject to any disclaimer, the term of this patent is extended or adjusted under 35 U.S.C. 154(b) by 806 days.

(21) Appl. No.: 11/138,688

(22) Filed: May 27, 2005

(65) Prior Publication Data

US 2006/0007104 A1 Jan. 12, 2006

(30) Foreign Application Priority Data

May 28, 2004 (KR) ..... 10-2004-0038344

(51) Int. Cl.
*G09G 3/36* (2006.01)

(52) U.S. Cl. ..... 345/102; 345/89

(58) Field of Classification Search ..... 345/89, 345/102, 690; 315/224
See application file for complete search history.

(56) References Cited

U.S. PATENT DOCUMENTS 6,317,347 B1 * 11/2001 Weng ..... 363/134
6,388,716 B1 * 5/2002 Tsuzuki et al. ..... 348/687
6,502,945 B2 * 1/2003 Kim et al. ..... 362/27
6,936,975 B2 * 8/2005 Lin et al. ..... 315/224
6,977,642 B2 * 12/2005 Nagatani ..... 345/102
7,025,488 B2 * 4/2006 Akiho ..... 362/613
7,286,193 B2 * 10/2007 Yoo et al. ..... 349/62
2003/0067436 A1 * 4/2003 Hara et al. ..... 345/102
2003/0090455 A1 * 5/2003 Daly ..... 345/102
2003/0164815 A1 * 9/2003 Nagatani ..... 345/102
2003/0234762 A1 * 12/2003 Nakatsuka et al. ..... 345/102
2004/0061814 A1 * 4/2004 Kim et al. ..... 349/65
2004/0239580 A1 * 12/2004 Nagatani et al. ..... 345/1.3
2005/0134547 A1 * 6/2005 Wyatt ..... 345/102

* cited by examiner

*Primary Examiner* — Quan-Zhen Wang
*Assistant Examiner* — Calvin C Ma
(74) *Attorney, Agent, or Firm* — McKenna Long & Aldridge LLP

(57) ABSTRACT

A method for controlling luminance of an edge type backlight unit having a plurality of lamps at opposite sides of a light-guiding plate is provided that includes: analyzing luminance data for each frame of an image before outputting the image; selecting a backlight luminance level from a Look-Up Table LUT that classifies the luminance according to the analyzed luminance data; outputting lamp on/off control signals according to the selected luminance level; and providing lamp on/off signals to respective lamps according to the lamp on/off control signals.

4 Claims, 3 Drawing Sheets

METHOD FOR CONTROLLING LUMINANCE OF BACKLIGHT UNIT

This application claims the benefit of Korean Application No. P2004-38344, filed on May 28, 2004, which is hereby incorporated by reference for all purposes as if fully set forth herein.

BACKGROUND OF THE INVENTION

1. Field of the Invention

The present invention relates to a backlight unit, and more particularly, to a method for controlling luminance of an edge type backlight unit having a plurality of lamps.

2. Discussion of the Related Art

Cathode ray tubes (CRT) have been widely used for television monitors, measuring machines, and information terminals. However, CRT technology cannot satisfy the increasing demand for miniaturized, light weight displays due to the size and weight of the CRT itself. As a result, alternative technologies such as liquid crystal display (LCD) devices that use an electric field optical effect, plasma display panels (PDP) that use a gas discharge, and electroluminescence display (ELD) devices that use an electric field luminous effect to display images have been developed to replace the CRT.

Due to its advantageous characteristics such as compact size, light weight and low power consumption, the LCD device has been actively studied to make it suitable for ultra-thin flat display devices, for example, monitors for spacecrafts, aircrafts, notebook computers, laptop computers, desktop computers and large-sized display devices. As a result, the demand for LCD devices continuous to increase.

Most LCD devices display images by controlling the transmittance of light from internal, external, or a combination of internal and external light sources. In general, backlight units used as internal light sources for LCD devices are classified into two types, the direct type and the edge type, according to the arrangement of the fluorescent lamps within the backlight unit.

In edge type backlight units, a lamp unit is provided at an edge or side of a light-guiding plate. The lamp unit includes a lamp that emits light, a lamp holder inserted onto both ends of the lamp to protect the lamp, and a reflective sheet attached to the light-guiding plate and surrounding the circumference of the lamp, to reflect the light emitted from the lamp towards the light-guiding plate. The edge type backlight unit is generally used in smaller sized LCD devices, for example, laptop and desktop computer monitors because of it has great uniformity of light, long life span, and a thin profile.

In the direct type backlight unit, a plurality of lamps are formed in a line on a lower surface of a light-diffusion sheet, whereby an entire surface of the LCD panel is directly illuminated with the light. Because the direct type backlight unit has greater light efficiency compared to the edge type backlight unit, it is generally used for the larger-sized LCD devices, for example 20 or more inches, requiring high luminance.

In the direct type LCD device, a plurality of lamps are provided underneath a screen of the LCD panel. Accordingly, if one of the lamps is turned off due to trouble with the lamp or the end of the lamp's life, the portion of the screen corresponding to the turned-off lamp becomes darker than the surrounding portions of the screen. In contrast, in the edge type backlight unit, when lamp is turned off, the over all luminance of the backlight is decreased slightly as opposed to a stark decrease in only a portion of the screen. In this respect, it is necessary for the direct type LCD device to have a simple structure suitable for disassemble and assemble of the lamp unit.

FIG. 1 illustrates an edge type backlight unit according to the related art. As illustrated in FIG. 1, the edge type backlight unit includes a lamp 10 positioned at opposite sides of a light-guiding plate 11, a light-diffusion sheet 12, a prism sheet 13, a housing structure 15, and a lower reflective sheet 16. An LCD panel 14 displays images thereon by controlling the transmittance of light emitted from the lamps 10. The light-guiding plate 11 guides the incident light, emitted from the lamps 10, towards the LCD panel 14, through the diffusion sheet 12 and the prism sheet 13. The light-diffusion sheet 12 diffuses the light guided by the light-guiding plate 11 to a predetermined angle, and the prism sheet 13 concentrates the diffused light, and sends the concentrated light to the rear of the LCD panel 14. Also, the housing structure 15 is positioned below the light-guiding plate 11. To minimize the loss of light, the lower reflective sheet 16 reflects the light progressing toward the housing structure 15 to the LCD panel 14.

The edge type backlight unit according to the related art further includes lamp reflective sheets 18 and lamp holders 17. Each of the lamp reflective sheets 18 covers the lamp 10 except for the surface incident to the light-guiding plate 11, thereby decreasing the loss of light incident on the light-incidence surface of the light-guiding plate 11 from the lamp 10. In addition, the lamp holders 17 are positioned at each end of the lamp 10 to position the lamp 10 and to maintain a predetermined interval between the light-incidence surface of the light-guiding plate 11 and the lamp 10.

In the aforementioned edge type backlight unit, the plurality of light-diffusion sheets 12 and prism sheets 13 may be deposited as need.

When the edge type backlight unit according to the related art is used in a monitor, a lamp 10 is positioned at opposite sides of the light-guiding plate 11. However, if high luminance is required, a plurality of lamps 10 may be positioned at opposite sides of the light-guiding plate 11 depending to the size of the LCD panel 14. In either case, all the lamps 10 are simultaneously turned on or off according to the related art.

In the related art edge type backlight unit, the plurality of lamps 10, arranged at opposite sides of the light-guiding plate 11 are operated simultaneously, thereby controlling the entire luminance of the LCD panel 14. As a result, the related art cannot partially control the luminance of the LCD panel according to the displayed images.

SUMMARY OF THE INVENTION

Accordingly, the present invention is directed to a method for controlling luminance of a backlight unit that substantially obviates one or more problems due to limitations and disadvantages of the related art.

An advantage of the present invention is to provide a method for controlling luminance of an edge type backlight unit having a plurality of lamps at opposite sides of a light-guiding plate.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these objects and other advantages and in accordance with the purpose of the invention, as embodied and broadly described, a method for controlling luminance of an edge type backlight unit having a plurality of lamps at opposite sides of a light-guiding plate, is provided comprising: analyzing luminance data for each frame of an image before outputting the image; selecting a luminance level from a Look-Up Table LUT that classifies luminance according to the analyzed luminance data; outputting lamp on/off control signals according to the selected luminance level; and providing lamp on/off signals to respective lamps according to the lamp on/off control signals.

In another aspect of the present invention, a method for controlling luminance of an edge type backlight unit having a plurality of lamps at opposite sides of a light-guiding plate, is provided comprising: analyzing luminance data for each frame of an image before outputting the image; selecting a luminance level from a Look-Up Table that classifies the luminance according to the analyzed luminance data; outputting lamp on/off control signals and lamp-dimming control signals according to the selected luminance level; and providing lamp on/off signals to respective lamps according to the lamp on/off control signals and the lamp-dimming control signals.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE INVENTION

Reference will now be made in detail to embodiments of the present invention, examples of which are illustrated in the accompanying drawings. Wherever possible, the same reference numbers will be used throughout the drawings to refer to the same or like parts.

Figure 1:
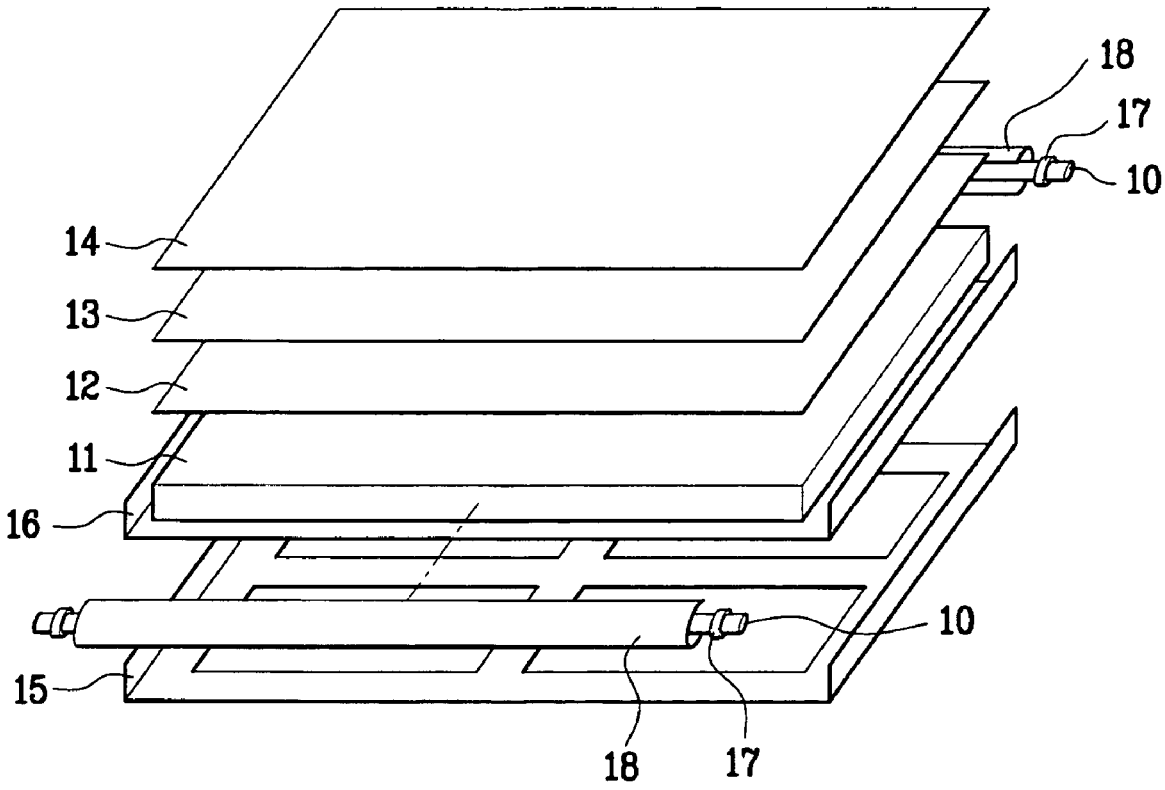
FIG. 1 Related Art
FIG. 1 illustrates an edge type backlight unit according to the related art.
Figure 2:
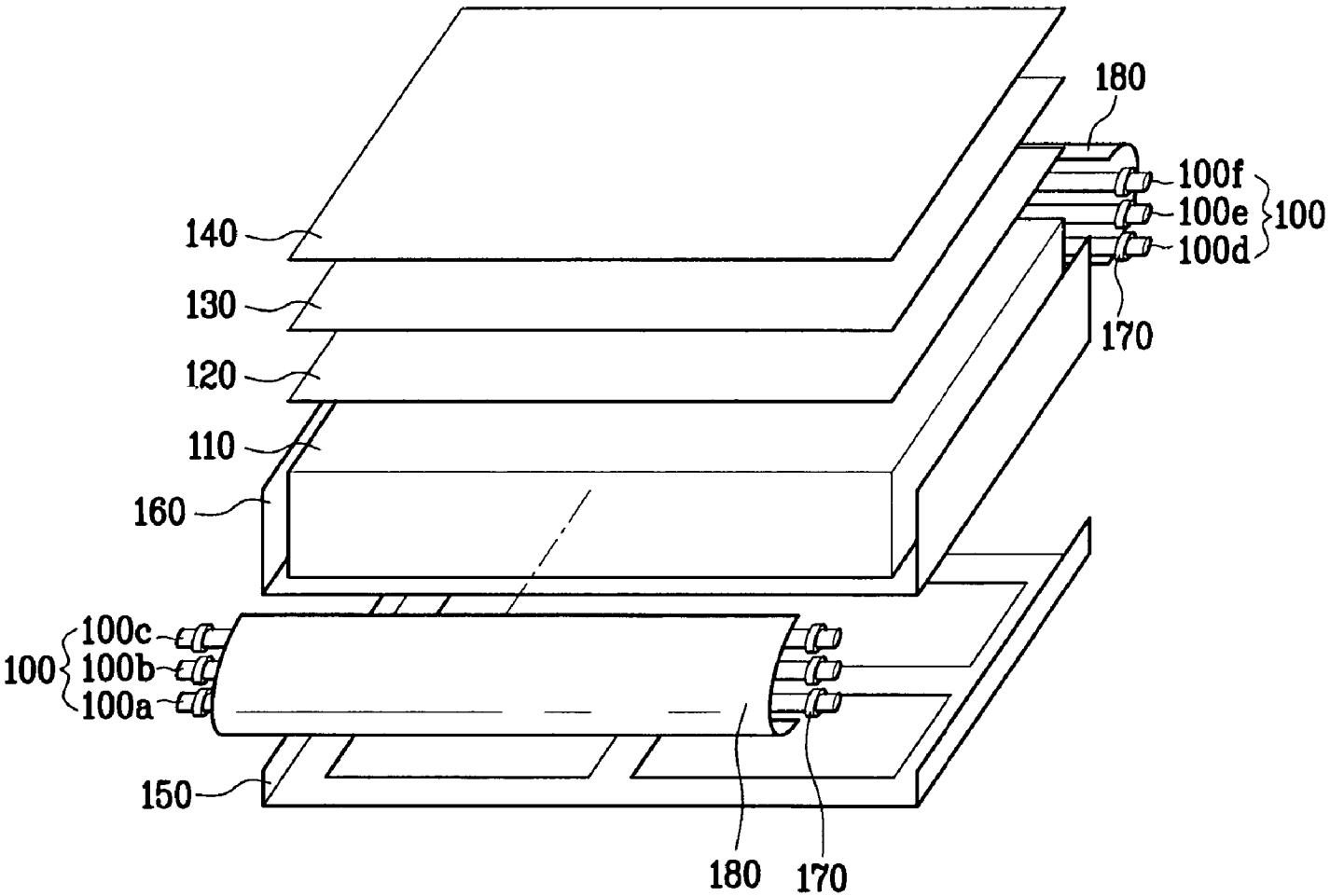
FIG. 2 illustrates an edge type backlight unit according to an embodiment of the present invention.

FIG. 2 illustrates an edge type backlight unit according to an embodiment of the present invention. As illustrated in FIG. 2, the edge type backlight unit according to the present invention includes, a lamp unit 100, a light-guiding plate 110, a light-diffusion sheet 120, a prism sheet 130, a lower reflective sheet 160, and a housing structure 150 positioned below the light-guiding plate 110. The LCD panel 140 displays images thereon by controlling the transmittance of the light emitted from the lamp unit 100. More specifically, the light-guiding plate 110 guides the emitted light to the light-diffusion sheet 120 which diffuses the light to a predetermined angle. Then, prism sheet 130 concentrates the diffused light, and sends the concentrated light to the rear of the LCD panel 140. To minimize the loss of light, the lower reflective sheet 160 reflects the light progressing toward the housing structure 150 to the LCD panel 140.

The lamp unit 100 is provided with a plurality of lamps arranged at opposite sides of the light-guiding plate 110. As illustrated in FIG. 2, the six lamps, three on each side, are arranged at opposite sides of the light-guiding plate 110, wherein the three lamps arranged at one side of the light-guiding plate 110 are referred to as the first, second and third lamps 100*a*, 100*b* and 100*c* in sequence, and the three lamps arranged at the other side of the light-guiding plate 110 are referred to as the fourth, fifth and sixth lamps 100*d*, 100*e* and 100*f*.

The edge type backlight unit according to the present invention also includes lamp reflective sheets 180 and lamp holders 170. Each of the lamp reflective sheets 180 is positioned such that it covers the lamps 100*a*-100*f* except for the portion of the lamps incident to the side of the light-guiding plate 110. The lamp reflective sheets decrease the loss of light by reflecting light towards the light-guiding plate 110. Lamp holders 170 are positioned at each end of the lamps 100*a*-100*f*, to secure the lamps 100*a*-100*f* a predetermined position, and to maintain a predetermined interval between the light-incidence surface of the light-guiding plate 110 and the lamps 100*a*-100*f*. Further, electrodes (not shown) formed at each end of the lamps 100*a*-100*f* are electrically connected with one inverter (not shown) by wires.

The plurality of light-diffusion sheets 120 and prism sheets 130 may be deposited as need.

Each lamp 100*a*-100*f* is a cold cathode fluorescent lamp CCFL. In the CCFL, electrodes are formed at each end of a tube. Accordingly, the CCFL may be turned on and off according to signals provided from an inverter by the power wires. At this time, the power wires are electrically connected with the inverter by an additional connector (not shown).

Figure 3:
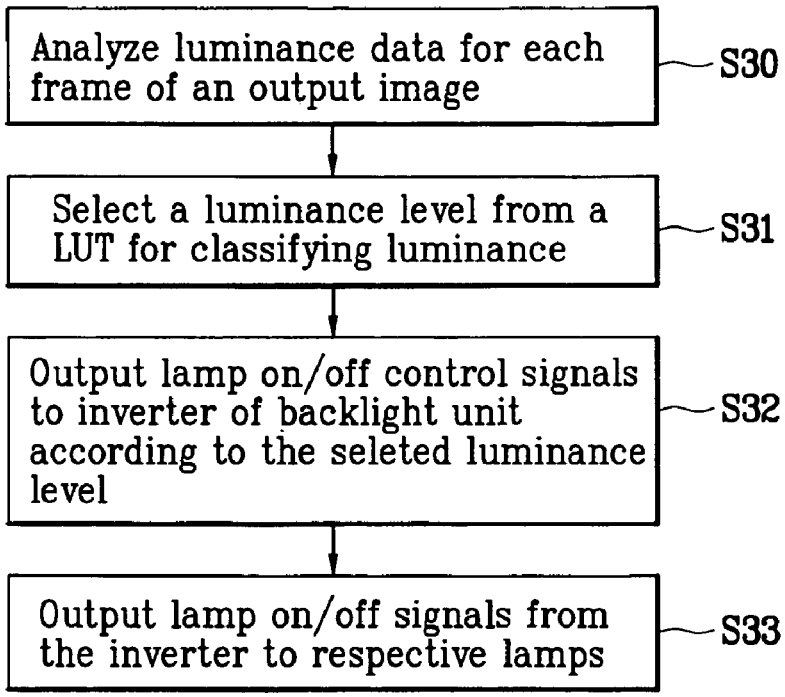
FIG. 3 is a flowchart illustrating a method for controlling luminance of an edge type backlight unit according to an embodiment of the present invention.

FIG. 3 is a flowchart illustrating a method for controlling luminance of an edge type backlight unit according to an embodiment of the present invention. As shown in FIG. 3, the method largely includes four steps. First, the luminance data for each frame of an image is analyzed before outputting the image at step S30. Then, at step S31, a backlight luminance level is selecting from a Look-Up Table LUT that classifies the luminance according to the analyzed luminance data. At step S32, lamp on/off control signals are outputted to the inverter of the backlight unit according to the selected luminance level. Then, at step S33, the inverter turns the respective lamps on and off according to the lamp on/off control signals.

Figure 4:
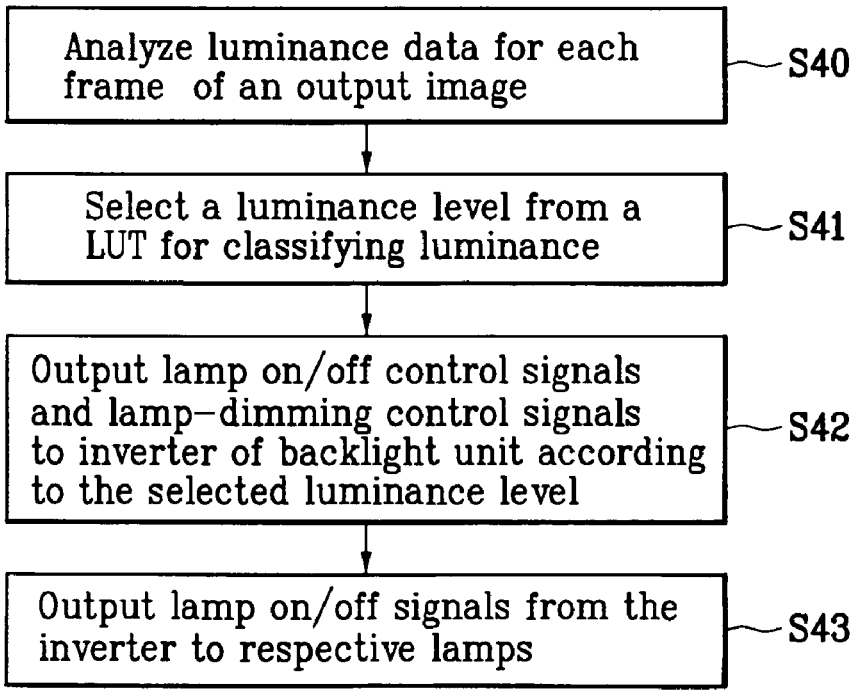
FIG. 4 is a flowchart illustrating a method for controlling luminance of an edge type backlight unit according to another embodiment of the present invention.

FIG. 4 is a flowchart of a method for controlling luminance of an edge type backlight unit according to another embodiment of the present invention. As illustrated in FIG. 4, the method for controlling the luminance of the backlight unit according to the second embodiment of the present invention largely includes four steps. First, as in the method described above, the luminance data for each frame of an image is analyzed before outputting the image at step S40. Then, at step S41, a backlight luminance level is selecting from a Look-Up Table LUT that classifies the luminance according to the analyzed luminance data. At step S42, lamp on/off control signals and lamp-dimming control signals are outputted to the inverter of the backlight unit according to the selected luminance level. Then, at step S43, the inverter controls the each of the lamps according to the lamp on/off and dimming control signals.

The lamp-dimming control signal may be included a pulse width modulation PWM method or an analog variable resistance control method. Specifically, the lamp-dimming control signals may be applied using a burst inverter where a PWM method is utilized, or using an analog inverter where an analog variable resistance control method is utilized.

The Look-Up Table LUT for classifying the luminance may be variously and optionally changed. For example, the entire luminance data may be classified into 'n' levels, and the luminance divided into minimum, intermediate and maximum luminance levels. The three luminance levels may be divided equally, or differently.

In the aforementioned Look-Up Table LUT, the three levels of minimum, intermediate, and maximum luminance are defined, and the number of lamps being turned on in each of the three luminance levels is preset. For example, assuming six lamps arranged as illustrated in FIG. 2, first, the luminance date of 0 to 255 (8 bits) is equally divided into three levels, comprising minimum, intermediate and maximum luminance levels. Specifically, in case of the minimum luminance level, it is preset that one of the first to third lamps 100*a*, 100*b* and 100*c* arranged at one side of the light-guiding plate 110 is turned on, and one of the fourth to sixth lamps 100*d*, 100*e* and 100*f* arranged at the other side of the light-guiding plate 110 is turned on. In the intermediate luminance level, it is preset that two of the first to third lamps 100*a*, 100*b* and 100*c* arranged at one side of the light-guiding plate 110 are turned on, and two of the fourth to sixth lamps 100*d*, 100*e* and 100*f* arranged at the other side of the light-guiding plate 110 are turned on. In the maximum luminance level, it is preset that all of the lamps 100*a*-100*f* are turned on.

Accordingly, if the luminance data in a frame is determined to be about 100, then using the LUT according to the present invention, the lamp on/off control signal corresponding to the intermediate luminance level would be outputted to the inverter. Accordingly, the inverter receives the lamp on/off control signal, and then outputs the lamp on/off signal to the respective lamps, whereby two of the first to third lamps 100*a*, 100*b* and 100*c* arranged at one side of the light-guiding plate 110 are turned on, and two of the fourth to sixth lamps 100*d*, 100*e* and 100*f* arranged at the other side of the light-guiding plate 110 are turned on.

In the embodiments discussed above, one inverter provides control singles to all the lamps. However, a seperate inverter may be provided for each of the lamps. Accordingly, the lamp on/off signal is outputted to each of the lamps in the respective luminance level.

Although not shown, the number of lamps arranged at one side of the light-guiding plate 110 may be different from the number of lamps arranged at the other side of the light-guiding plate 110. In this state, the methods for controlling the luminance according to the first and second embodiments of the present invention are applied thereto, so that the luminance can be differently controlled in the both sides of the light-guiding plate 110. That is, in state of differently providing the number of lamps in the both sides of the light-guiding plate 100, it is possible to control the luminance with the lamp on/off signals according to the first embodiment of the present invention, or it is possible to control the luminance with the lamp on/off signals and the lamp-dimming control signals according to the second embodiment of the present invention.

The method for controlling the luminance of the backlight unit according to the present invention has the following advantages. First, in the edge type backlight unit having the plurality of lamps at both sides of the light-guiding plate, the plurality of lamps can be respectively controlled according to the displayed images, so that it is possible to improve the picture quality by improving the contrast ratio. Furthermore, it is possible to increase the range of the maximum luminance level and the minimum luminance level of the displayed images by respectively controlling the plurality of lamps.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A method for controlling luminance of an edge type backlight unit having a plurality of lamps at opposite sides of a light-guiding plate, the method comprising:

analyzing luminance data for each frame of an image before outputting the image;

selecting a luminance level from a Look-Up Table and outputting lamp on/off control signals from the Look-Up Table according to the selected luminance level, wherein the Look-Up Table includes first, second and third luminance levels classified according to the analyzed luminance data and preset lamp on/off control signals that provide a number of lamps being turned-on for each of the three luminance levels, wherein the second luminance level is higher than the first luminance level and the third luminance level is higher than the second luminance level, wherein the number of lamps being turned-on for the each luminance level is different from the number of lamps being turned-on for each of other luminance levels; and providing lamp on/off signals to respective lamps according to the lamp on/off control signals from the Look-Up Table, wherein the lamps are of the same type, wherein the number of the lamps being turned on is adjusted according to the lamp on/off control signals from the Look-Up Table for the three luminance levels so that the number of lamps being turned-on for the each luminance level is different from the number of lamps being turned-on for each of other luminance levels, and the number of the lamps being turned on is different according to the three luminance levels, wherein a first number of the lamps turned-on at a first side of light-guiding plate is the same as a second number of the lamps turned-on at a second side of light-guiding plate for each of the three luminance levels, wherein when the first luminance level, there are turned-on at least one of the lamps placed at the first side and at least one of the lamps placed at the second side, wherein when the third luminance level, there are turned-on all the lamps placed at the first and second sides, and wherein a number of the lamps turned-on in the second luminance level is larger than that of the lamps turned-on in the first luminance level and smaller than that of the lamps turned-on in the third luminance level.

2. A method for controlling luminance of an edge type backlight unit having a plurality of lamps at opposite sides of a light-guiding plate, the method comprising:

analyzing luminance data for each frame of an image before outputting the image;

selecting a luminance level from a Look-Up Table that classifies the luminance according to the analyzed luminance data and outputting lamp on/off control signals from the Look-Up Table according to the selected luminance level, wherein the Look-Up Table includes first, second and third luminance levels classified according to the analyzed luminance data and preset lamp on/off control signals that provide the number of lamps being turned-on for each of the three luminance levels, wherein the second luminance level is higher than the first luminance level and the third luminance level is higher than the second luminance level, wherein the number of lamps being turned-on for the each luminance level is different from the number of lamps being turned-on for each of other luminance levels;

outputting lamp-dimming control signals according to the selected luminance level; and providing lamp on/off signals to respective lamps according to the lamp on/off control signals from the Look-Up Table and the lamp-dimming control signals, wherein the lamps are of the same type, wherein the number of the lamps being turned on is adjusted according to the lamp on/off control signals from the Look-Up Table for the three luminance levels so that the number of lamps being turned-on for the each luminance level is different from the number of lamps being turned-on for each of other luminance levels, and the number of the lamps being turned on is different according to the lamp on/off control signals from the Look-Up Table for the three luminance levels, wherein a first number of the lamps turned-on at a first side of light-guiding plate is the same as a second number of the lamps turned-on at a second side of light-guiding plate for each of the three luminance levels, wherein when the first luminance level, there are turned-on at least one of the lamps placed at the first side and at least one of the lamps placed at the second side, wherein when the third luminance level, there are turned-on all the lamps placed at the first and second sides, and wherein a number of the lamps turned-on in the second luminance level is larger than that of the lamps turned-on in the first luminance level and smaller than that of the lamps turned-on in the third luminance level.

3. The method of claim 2, wherein the lamp-dimming control signal applied in a pulse width modulation PWM method or an analog variable resistance control method.

4. The method of claim 3, wherein the lamp-dimming control signal is applied using a burst inverter, or using an analog inverter.

* * * * *